US006252205B1

(12) United States Patent
Schultheis et al.

(10) Patent No.: US 6,252,205 B1
(45) Date of Patent: Jun. 26, 2001

(54) MOUNTING ARRANGEMENT FOR A COOKING SURFACE

(75) Inventors: Bernd Schultheis, Schwabenheim; Werner Hottum, Bechenheim, both of (DE)

(73) Assignee: Schott Glas (DE)

( * ) Notice: Subject to any disclaimer, the term of this patent is extended or adjusted under 35 U.S.C. 154(b) by 0 days.

(21) Appl. No.: 09/355,021

(22) PCT Filed: Mar. 12, 1997

(86) PCT No.: PCT/EP97/06754

§ 371 Date: Jul. 19, 1999

§ 102(e) Date: Jul. 19, 1999

(87) PCT Pub. No.: WO98/34070

PCT Pub. Date: Aug. 6, 1998

(30) Foreign Application Priority Data

Jan. 31, 1997 (DE) ..... 197 03 542

(51) Int. Cl.[7] ..... H05B 3/68
(52) U.S. Cl. ..... 219/452.11
(58) Field of Search ..... 219/451.1, 452.12, 219/452.11, 460.1; 126/211, 217, 218, 393, 394, 90 A, 92 A

(56) References Cited

U.S. PATENT DOCUMENTS 4,363,956 * 12/1982 Scheidler et al. ..... 219/452.12
4,453,533 * 6/1984 Scheidler et al. ..... 126/211
5,036,831 * 8/1991 Ray ..... 219/452.12
5,584,957 * 12/1996 Schultheis et al. ..... 156/286
5,768,979 * 6/1998 Antoine ..... 126/211
5,844,206 * 12/1998 Steiner et al. ..... 219/452.12

FOREIGN PATENT DOCUMENTS

3341210A21 11/1983 (DE) .
19525825A1 7/1995 (DE) .
296 20 838 U1 11/1996 (DE) .
0748676A1 12/1996 (EP) .
2 744 201 1/1996 (FR) .

* cited by examiner

*Primary Examiner*—Sang Paik
(74) *Attorney, Agent, or Firm*—Jansson, Shupe & Munger, Ltd.

(57) ABSTRACT

A mounting arrangement for a cooking surface is provided. The cooking surface has an edge at one end thereof which is rounded and which is at least partially surrounded by a plastic frame or frame sections. The cooking surface can be supported on the frame or by the frame sections in an opening in a work-plate. The frame or frame sections include a support section which supports a bottom surface of the cooking surface. The frame or frame sections are made of a heat-resistant plastic reactive foam. The reactive foam is injection molded or foamed into a mold in which the cooking surface is housed. In this manner, a mounting arrangement can be easily manufactured without affecting the stability of the cooking surface.

12 Claims, 1 Drawing Sheet

MOUNTING ARRANGEMENT FOR A COOKING SURFACE

RELATED APPLICATION AND CLAIM OF PRIORITY

Figure 1:
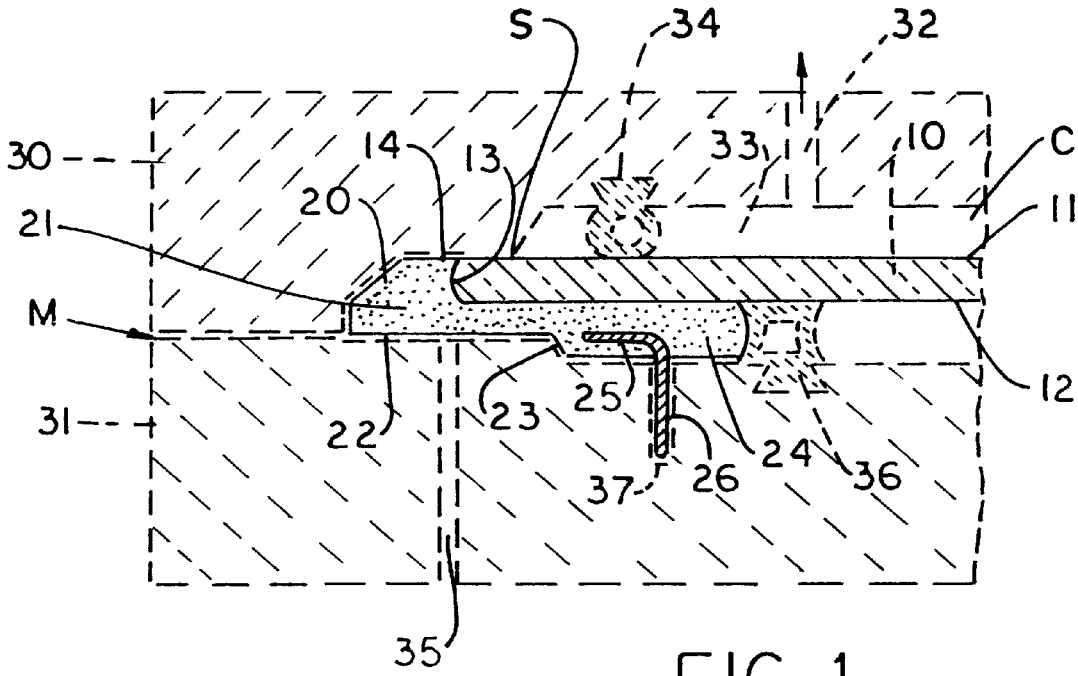

This application is a nationalization of PCT Application No. PCT/EP97/06754 having an international filing date of Aug. 6, 1998, which designates at least one country in addition to the United States and which claims priority from German Application No. 197 03 542.6 filed Jan. 31, 1997. For priority purposes, this application continues the above-noted PCT application and claims the benefit of 35 USC 371 and/or 35 USC 120.

FIELD OF THE INVENTION

The invention pertains to a mount for a cooking surface, the edge of which is surrounded at least in parts by a frame or sections of a frame comprised of plastic, whereby the cooking surface with the frame (the frame sections) can be supported in an opening of a work plate, and whereby the frame (the frame sections) features a support section that underpins the cooking surface on its underside.

BACKGROUND OF THE INVENTION

Such a mount is known from EP 0 449 347 B1. The cooking surface is formed of a glass ceramic plate or the like. The edge of this glass ceramic plate is hereby encompassed by a circumscribing frame. The frame overlaps the upper and the lower side of the cooking surface, so that the edge is completely enshrouded. The frame itself is sprayed directly onto the cooking surface in a plastic injection molding process. The plastic, in a hot and paste-like state, is hereby injected into an appropriate injection mold into which the cooking surface is also laid. As the plastic cools is solidifies into the frame that tightly applies to the cooking surface. Upon cooling, the plastic shrinks as a result of polymerization processes. The frame pulls together as a result of this material change. It is accompanied by a tensioning in the cooking surface. This has a disadvantageous effect on the stability of the cooking surface.

It is the task of the invention to provide a mount of the above indicated type that can be attached to the cooking surface in a simple manner without influencing the stability.

SUMMARY OF THE INVENTION

This task is accomplished in that the frame (the frame sections) is formed of a temperature resistant plastic reactive foam which is foamed onto the cooking surface.

A low viscosity substance is introduced into a tool mold in order to produce such a mount. This tool mold also receives the cooking surface. The low viscosity substance foams-up, forming the reactive foam. This applies itself without tension to the edge of the cooking surface, where it hardens. This hardening process does not result in shrinkage. Thus, no stress is brought to bear on the cooking surface. The reactive foam features good adhesion, so that the cooking surface is securely fixed. In particular, the cooking surface does not necessarily need to be surrounded by the reactive foam in the edge area on the upper and lower side. If is sufficient if, for example, only the cooking surface is underpinned by the support section. According to the invention, individual frame sections can also be attached at predetermined positions on the cooking surface. This property permits a wider range of design opportunities.

A preferred design variant of the invention provides that the frame/the frame section (in the following the frame section is referred to as the frame for the sake of simplicity) features a lateral part connected to the support section, guided applied against the cooking surface toward the upper side of the cooking surface, and that the cooking surface features a draft in the edge area allocated to the lateral part, said draft, in conjunction with the reactive foam, being under-foamed in order to form an undercut. A mold closure constructed in this manner prevents the cooking surface from releasing from the support section, even when great stress is present. In particular, the draft can be built as a round part of the edge of the cooking surface.

If it is provided that function elements are embedded in the reactive foam of the frame, then other design variants can be materialized in a simple manner. In particular, it is possible that one or more holding parts constructed as function elements are foamed into the support section of the frame, projecting at the underside of the cooking surface and on which one or more installation units can be fastened. For example, it is conceivable that a housing is fixed to the mount as an installation unit, said housing lodging heating elements. Depending on the design of the function elements, it is also possible to connect only an installation plate to the mount, for the heating elements.

Anchor elements are connected to these in order to securely fix the function elements, said anchor elements extending transverse to the direction of principal load that acts on the function elements.

Furthermore, it is conceivable that one or more catch receptacles can be formed into the frame, onto which supplemental parts can be engaged. For example, a cover section with a panel that at least partially covers the visible surface can be used. The panel alone can act as the characterizing feature, as a design element for visual appearance. It is also conceivable to have the panel constructed of high quality material as compared to the mounting; scratch resistant, harmless to foodstuffs and temperature resistant.

The reactive foam for example, can be formed of silicone or polyurethane or of EPDM or PTFE. Silicone and polyurethane are particularly temperature resistant, and they are not damaged, even if, e.g., hot pans are set on the mount.

If it is provided that the frame (the frame sections) connected to the upper side of the cooking surface transitions into an oblique, downwardly directed flank, and/or that the frame (the frame section) connected to the edge of the cooking surface features a shoulder that can spring back relative to the upper side of the cooking surface, then a pan that is placed in the area over the mount does not come into direct contact with the reactive foam. On the contrary, an insulating air gap is formed.

BRIEF DESCRIPTION OF THE DRAWING FIGURES

Figure 2:
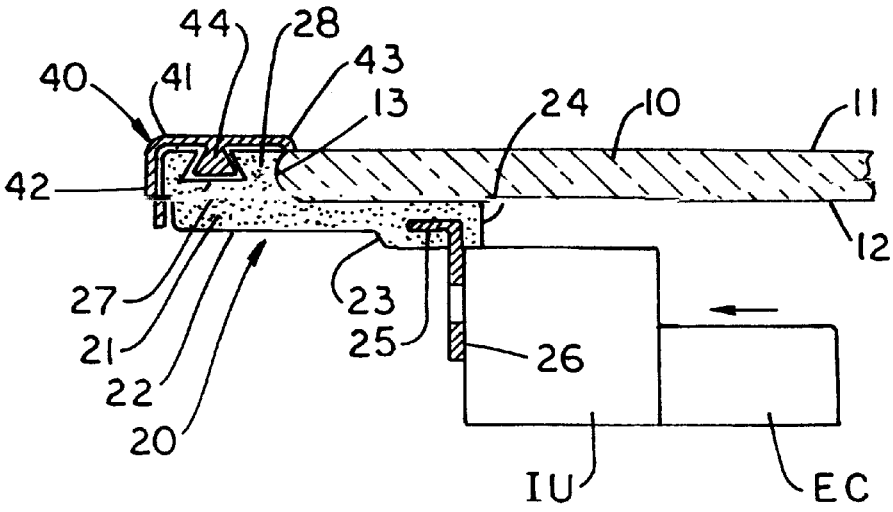

The invention is explained in more detail in the following on the basis of exemplified embodiments as illustrated in the drawings. Shown are:

FIG. 1 a cooking surface with a mount and a tool in lateral view and in partial illustration, and FIG. 2 a further possible design for a mount in lateral illustration and in partial view.

DETAILED DESCRIPTION OF THE INVENTION

FIG. 1 shows a tool comprising a tool mold upper part 30 and a tool mold lower part 31. The tool is illustrated by dashed lines, so that the mount 20 pertaining to the invention and the cooking surface 10 can be clearly recognized. The tool mold upper part 30 possesses a support, with which it rests on the upper side 11 in the area of the edge of the cooking surface 10. In the remaining area of the cooking surface the tool is set back relative to the upper side 11, so that a negative pressure chamber 33 results. The negative pressure chamber 33 is sealed off toward the support by means of a sealing element 34. A negative pressure pump can be connected to the channel 32 of the tool mold upper part 30. The channel 32 is spatially connected to the negative pressure chamber 33. If the pressure is reduced in the negative pressure chamber 33 by means of the negative pressure pump, the cooking surface 10 is pulled against the support. It is thereby fixed in the tool.

The tool mold lower part 31 is arranged below the underside 12 of the cooking surface 10. The tool mold lower part 31 is supported against the underside 12 by means of an elastic mold piece 36. The tool mold lower part 31 features a receptacle 37 with some space to the mold piece 36 in the direction toward the edge 13 of the cooking surface 10. A function element 26 can be inserted in this receptacle 37. A low viscosity substance can be injected by means of an injection channel 35. This substance is comprised of two components that are mixed before entering the injection channel 35. If the low viscosity substance is injected into the area of the edge 13 of the cooking surface 10, a reactive foam forms after a short period of time. This permits a frame 20 to be created, encompassing the edge 13 of the cooking surface 10.

The frame 20 has a support section 24 that underpins the cooking surface on its underside 12. The function element 26 is embedded in this support section 24 with an anchor 25. The support section 24 transitions into a supporting surface 22 by means of a shoulder 23. The mount 20 can be fixed in an opening in the work plate with the support surface 22. The shoulder 23 in this case serves as an aid for centering.

As is shown in the illustration in FIG. 1, the edge 13 of the cooking surface 10 is rounded. A draft 14 is hereby back-filled with the reactive foam, so that an undercut is formed. The undercut produces a mold closure between the cooking surface 10 and the mounting 20. In addition, as a result of the good adhesion of the reactive foam to the cooking surface, it prevents the cooking surface 10 from being pressed out of the mount 20 by any great stress.

FIG. 2 illustrates a further design variant of a mount 20. The mount 20, like the mount 20 according to FIG. 1, has one or more function elements 26. Installation units can be fastened to these, and are not illustrated in the drawing to enhance the visual overview. The installation units can, for example, receive electronic components or the like.

A catch receptacle 27 is placed in an upwardly facing visible surface 28 of the mount 20. A catch projection 44 of a supplemental part 40 can be engaged in the catch receptacle 27. The supplemental part 40 in the present case is provided with a panel 41 which covers the visible surface 28. A lateral part 42 connects to the panel 41, said lateral part 42 overlapping the edge of the mount 20. A sealing lip can be formed onto the end of the panel 41 that is turned away from the lateral part 42. The sealing lip 43 is supported on the upper side 11 of the cooking surface 10. It prevents dirt from getting into the area between the panel 41 and the mount 20. The panel 41 can be manufactured of plastic or metal. In particular, it has been shown to be advantageous is the panel 41 and the lateral part 42 are temperature resistant and scratch resistant, so that any stress can be kept away from the frame of the mount 20. In particular, the panel 41 may also be applied only to partial areas of the frame, or be used as a design element.

The invention is not limited solely to the applications shown in the exemplified embodiments. Instead, it is also conceivable that, instead of a cooking surface, other glass ceramic or other non ductile materials can also be provided with a frame.

What is claimed is:

1. A mounting arrangement for a cooking surface, the cooking surface having an upperside, an underside, and a rounded edge between the upperside and the underside, said mounting arrangement comprising:

any one of a frame and frame sections having a support section for supporting a portion of the underside of the cooking surface in an opening of a work-plate such that a portion of the rounded edge and the portion of the underside of the cooking surface are adhered to by any one of said frame and said frame sections, wherein any one of said frame and said frame sections are made of a temperature resistant, plastic reactive foam material and said frame and said frame sections provide the sole mounting support for the cooking surface.

2. The mounting arrangement according to claim 1, wherein any one of said frame and said frame sections include said support section having a shoulder such that said shoulder transitions into a lateral portion and said lateral portion includes a somewhat triangular-shaped portion adjacent to an upper portion of the rounded edge of the cooking surface.

3. The mounting arrangement according to claim 2, wherein said lateral portion of any one of said frame and frame sections has an upwardly facing visible surface which is slightly lower in height than the upperside of the cooking surface.

4. The mounting arrangement according to claim 3, further comprising a supplemental part including a lateral part connected approximately perpendicularly to a first end of a panel, wherein said panel has a sealing lip extending from a second end thereof and a catch projection extending from a side thereof so that said catch projection can mate with a catch receptacle in any one of said frame and said frame sections.

5. The mounting arrangement according to claim 4, wherein said panel acts to cover an upwardly facing visible surface of a lateral portion of any one of said frame and said frame sections.

6. The mounting arrangement according to claim 5, further comprising functional elements which are at least partially embedded in said reactive foam material of any one of said frame and said frame sections.

7. The mounting arrangement according to claim 6, wherein said functional elements include at least one anchoring member, which is molded into a support section of any one of said frame and said frame sections, and at least one free end, which projects from the underside of the cooking surface for attachment of at least one installation unit thereto.

8. The mounting arrangement according to claim 7, wherein said at least one installation unit is preferably for receiving electronic components.

9. The mounting arrangement according to claim 7, wherein said at least one anchoring member of said functional elements extend transverse to a direction in which a principal load is acting on said functional elements.

10. The mounting arrangement according to claim 1, wherein said reactive foam material of any one of said frame and said frame sections is any one of a group consisting of silicone, polyurethane, EPDM and PTFE.

11. The mounting arrangement according to claim 10, wherein any one of said frame and said frame sections is connected to the underside of the cooking surface to form an oblique, downwardly directed flank at a shoulder for centering the cooking surface within the opening in the workplate.

12. The mounting arrangement according to claim 2, wherein said shoulder is a centering means for centering any one of said frame and said frame sections in the opening in the workplate.

* * * * *